US007090329B2

(12) United States Patent
Nellen

(10) Patent No.: US 7,090,329 B2
(45) Date of Patent: Aug. 15, 2006

(54) PRINT CARRIAGE ASSEMBLY AND METHOD FOR MOUNTING A PRINT HEAD HOLDER THEREON

(75) Inventor: Wilhelmus H. J. Nellen, Venlo (NL)

(73) Assignee: Oce-Technologies B.V., Ma Venlo (NL)

( * ) Notice: Subject to any disclaimer, the term of this patent is extended or adjusted under 35 U.S.C. 154(b) by 274 days.

(21) Appl. No.: 10/702,479

(22) Filed: Nov. 7, 2003

(65) Prior Publication Data

US 2004/0090488 A1 May 13, 2004

(30) Foreign Application Priority Data

Nov. 7, 2002 (EP) ..... 02079713

(51) Int. Cl.
*B41J 23/00* (2006.01)

(52) U.S. Cl. ..... 347/37

(58) Field of Classification Search ..... 347/40, 347/86

See application file for complete search history.

(56) References Cited

U.S. PATENT DOCUMENTS 5,539,436 A 7/1996 Wilson et al.
6,089,696 A * 7/2000 Lubinsky ..... 347/40
6,338,543 B1 * 1/2002 Lindenfelser ..... 347/40
6,644,780 B1 * 11/2003 Lodal et al. ..... 347/37

FOREIGN PATENT DOCUMENTS

EP 1 145 860 A1 10/2001

* cited by examiner

*Primary Examiner*—Thinh Nguyen
(74) *Attorney, Agent, or Firm*—Birch, Stewart, Kolasch & Birch, LLP

(57) ABSTRACT

A printing device containing print heads supported on a print carriage assembly wherein the print heads are attached to print head holders which are adapted to be placed on the print carriage assembly at predetermined positions ensuring alignment and accurate positioning of the respective print heads, particularly in the sub scanning direction. Also disclosed is a method for mounting a print head holder on a print carriage assembly.

14 Claims, 5 Drawing Sheets

PRINT CARRIAGE ASSEMBLY AND METHOD FOR MOUNTING A PRINT HEAD HOLDER THEREON

BACKGROUND OF THE INVENTION

This non-provisional application claims priority under 35 U.S.C. § 119(a) on Patent Application No. 02079713.0 filed in Europe on Nov. 7, 2002, which is herein incorporated by reference.

1. Field of the Invention

The present invention is relates to a printing device such as a printing or copying system employing multiple print heads containing discharge elements for the image-wise forming of dots of a marking substance on an image-receiving member. Examples of such printing devices are inkjet printers and toner-jet printers.

2. Related Art

Print heads employed in inkjet printers and the like usually contain a plurality of discharge elements arranged in (a) linear array(s) parallel to the propagation direction of the image-receiving member or in other words the sub scanning direction. The discharge elements usually are placed substantially equidistant. In operation, the discharge elements are controlled to the image-wise discharge of ink droplets on an image-receiving member to form columns of image dots of ink in relation to the linear arrays. The discharge activation may be thermally or thermally assisted and/or mechanically or mechanically assisted and/or electrically or electrically assisted, including piezoelectrically. In scanning inkjet printers, the print heads are supported by a print carriage which is movable over a guide member across the image-receiving member, i.e. in a direction perpendicular to the propagation direction of the image-receiving member or in other words the main scanning direction. In operation a scanning inkjet printer forms a matrix of image dots of ink corresponding to a part of an image by scanning the print heads at least once, optionally bi-directionally, over the image-receiving member in the main scanning direction. After a first matrix is completed the image-receiving member is displaced so as to enable the forming of the next matrix. This process may be repeated till a complete image is rendered.

Alignment of the print head(s) in inkjet printers, particularly in the sub scanning direction, is of the utmost importance as dot positioning errors may cause visual disturbances in the formed image. In scanning inkjet printers having multiple print heads, contiguous dots may originate from different print heads. Examples of such inkjet printers include multi-color printers having at least one print head per color, and multi-color printers having at least one print head for the black process color and at least one print head for the other process colors, and monochrome printers having multiple print heads for the black process color. Not only alignment of the respective print heads in such printers, particularly in the sub scanning direction is of utmost importance, but also accurate positioning of the print heads relative to each other. The alignment of the respective print heads relative to each other in the sub scanning direction can be controlled by accurately positioning the print heads with respect to a reference position. This reference position is typically the guide member, on which the print carriage assembly supporting the print heads is suspended. This is a challenging problem as the positioning accuracy should be in the range of several hundreds of micrometers, preferably several tens of micrometers, while the distance between the guide member and the respective print heads is typically in the range from a few centimeters to several tens of centimeters.

An approach to tackling this problem is providing a print carriage assembly containing built-in means for mounting the respective print heads to the assembly. As this built-in mounting means is located at fixed positions within the assembly, the position with respect to the points of suspension of the assembly is also determined. Therefore the positioning accuracy of the print heads depends on the dimensional tolerances used to manufacture the print carriage assembly. Consequently, to obtain a high positioning accuracy for the respective print heads, the print carriage assembly should be manufactured with a high degree of precision, i.e. the respective parts and/or components of the assembly should be manufactured and positioned using dimensional tolerances typically in the order of micrometers or less. Although it may be possible to manufacture print carriage assemblies with such stringent dimensional requirements, the costs involved would be too high to be of commercial use.

In European patent application EP 1145860, a print head assembly is disclosed which may be easily installed and removed from a fixed position on the printer wall via a snap-fit arrangement using resilient side-fingers.

SUMMARY OF THE INVENTION

It is an object of the present invention to provide a scanning printing device having a print carriage assembly, movable in the main scanning direction, wherein the print head(s) can be mounted on the assembly at such position as to obtain a predetermined alignment and positioning accuracy of the respective print heads, in particular in the sub scanning direction.

It is another object of the present invention to provide print head which are detachably attached to (a) print head holder(s) which, in turn, can be mounted to a print carriage assembly at (a) predetermined distance(s) from a reference position.

It is still another object of the present invention to provide a print head holder with flexible connection means such that it can be easily displaced within the print carriage assembly prior to attachment. Once the print head holder is attached to the print carriage assembly, displacement of the print head holder should be impossible or at least very limited.

Yet another object of the present invention is to manufacture a print head holder with high precision and a print carriage assembly with reduced precision.

For the alignment of a print head in a printing or copying device, the print heads should be attached to a print carriage assembly at a predetermined position. The present invention suggests the use of a print head holder which can be mounted in a predetermined position to obtain proper alignment, particularly in the sub scanning direction. This predetermined alignment position does not coincide with a same fixed position within each assembly but is located at a predetermined distance from a reference position. This reference position may be a fixed position in the print carriage assembly, such as e.g. an edge thereof. The reference position may also be a fixed location within the printing device. In the case of scanning printing devices, this reference position may be the guide member where the print carriage assembly supporting the print heads is suspended. By doing so, differences in the dimensions of the print carriage assembly, e.g. introduced in the manufacturing process, causing a shift in the position of a print head and consequently resulting in a misalignment which is too large to be compensated, can be avoided. Therefore according to a first aspect of the present invention, a printing device is disclosed comprising:

at least one print head for the image-wise forming of dots of a marking substance on an image-receiving member, at least one print head holder associated with the at least one print head for detachably attaching the at least one print head thereto, and a print carriage assembly for supporting the print head holder, wherein each of said at least one print head holders is mounted on the print carriage assembly at a predetermined position by means of at least one resilient member.

In the case where the printing device is a scanning printing device, a guide member is provided which extends across the image-receiving member. In this case, the print carriage is movable across the guide member in the main scanning direction.

Any marking substance can be used, including ink and toner. The image-receiving member may be an intermediate member or a medium. The intermediate member may be an endless member, such as a belt or drum, which can be moved cyclically. The medium can be in web or sheet form and may be composed of e.g. paper, film, cardboard, label stock, plastic or textile, and the like.

In one embodiment of the present invention, the predetermined position of each print head for obtaining proper alignment in the sub scanning direction is determined with respect to a guide member. The guide member may include at least one rod, which extends across the image receiving member in the main scanning direction, for guiding the print carriage assembly in reciprocation across the image-receiving member. To reduce friction, the print carriage assembly may be suspended on the guiding member by means of at least one bearing. For instance, in the case where the guide member comprises at least one rod, the print carriage assembly may be provided with at least one slide bearing for movably suspending the print carriage assembly on the rod. In the latter case, the predetermined position of the print head for obtaining proper alignment in the sub scanning direction may be determined with respect to the slide bearing.

In another embodiment of the present invention, each print head holder is mounted on the print carriage assembly by at least three resilient members. The use of a resilient member attached to the print head holder to mount the print head holder on the print head assembly at a predetermined position has the advantage that it facilitates the displacement of the print head holder within the print carriage assembly in order to reach the predetermined position. Moreover, the use of a resilient member ensures that a good contact is provided with the assembly, achieving a robust connection therewith. The use of three or more resilient members has the advantage that the print head holder is stably suspended in the print carriage assembly, or in other words, it is difficult to displace the print head holder once it is mounted in the assembly. As a consequence, alignment can be maintained, even after extended use of the printing device. The resilient member is preferably a spring, more preferable a leaf spring.

In another embodiment of the present invention, each print head holder comprises means for adjusting the position of the print heads attached thereto over a limited distance in the sub scanning direction with respect to the print head holder. This distance is typically less than one-half of the pitch of the discharge element. For instance a discharge element pitch of about 42 μm may be used which enables printing at a resolution of 600 dpi. In the latter case the limited distance is less than 21 μm. An advantage thereof is that one can compensate for the dimensional variation from print head to print head, e.g. within the print carriage assembly when employing multiple print heads, or for instance after replacement of a print head.

In another aspect of the present invention, a method is disclosed for mounting at least one print head on a print carriage assembly of a printing device using at least one print head holder for detachably attaching one or more of the print heads thereto, wherein at least one resilient member is attached to each of the print head holders, the method comprising the step of mounting each of the print head holders to the print carriage assembly by bringing the print head holder to a predetermined position in the print carriage assembly and attaching the resilient member attached to the print head holder to the print carriage assembly at said predetermined position. The attachment of the resilient member to the assembly can be advantageously executed by means of irradiation, glueing, or welding, more particularly laser welding.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

In relation to the appended drawings, the present invention is described in detail in sequence. Several embodiments are disclosed. It is apparent however that a person skilled in the art can imagine several other equivalent embodiments or other ways of executing the present invention. In particular, the present invention is not limited to inkjet or toner-jet printers of the scanning type, i.e. printers where the print heads are supported by a print carriage which is movable across the image-receiving member, but is also applicable to printers which do not perform a scanning operation in the main scanning direction. Print heads of these latter type printers may have a width, i.e. the maximal distance between discharge elements of a print head in the main scanning direction, equal to or larger than the width, i.e. the dimension in the main scanning direction, of the image-receiving member.

Figure 1:
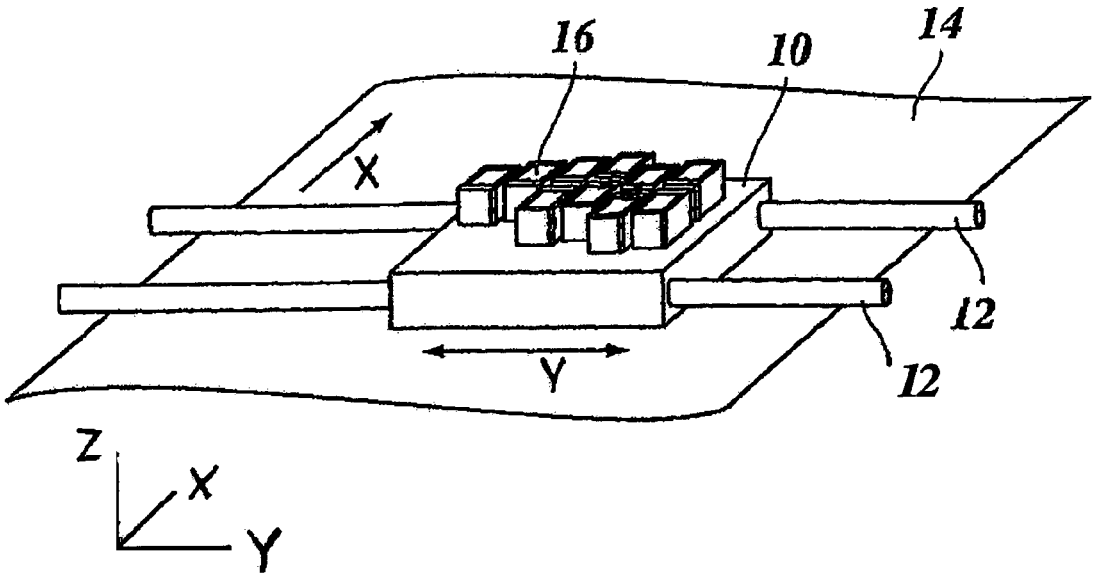
FIG. 1 depicts a perspective view of a scanning inkjet printer comprising a print carriage assembly according to one embodiment of the present invention.

The printing device of FIG. 1 is a scanning inkjet printer comprising a print carriage assembly 10 which can be moved in reciprocation in the main scanning direction Y over a guide member. The guide member comprises two rods 12 extending across the image-receiving member 14. In operation, the image-receiving member is fed by feeding means (not shown) in the sub scanning direction X. A number of print heads are mounted on the print carriage assembly using print head holders (not shown). The print head holders as well as the print carriage assembly will be described in more detail in connection with FIGS. 2 and 3. In this example 10 print heads 16 are mounted on the print carriage assembly for demonstrating the invention. In practice an arbitrary number of print heads may be employed. Each print head 16 is formed integrally with an ink cartridge which is the only part visible in FIG. 1. On the bottom side of the ink cartridge and on the bottom side of the print carriage assembly 10, i.e. facing the image-receiving member 14, each print head is provided with at least one array of discharge elements, so-called nozzles, and an associated drive system which may, for example, be formed by piezoelectric actuators and is configured to cause the individual discharge elements to image-wise discharge ink droplets at appropriate timings. As depicted in FIG. 1, the respective print heads are placed in a particular configuration. The respective print heads may be placed on the print carriage assembly adjacent to each other but such that the discharge elements of the respective print heads are positioned in a staggered configuration instead of in-line. For instance, this may be done to increase the print resolution or to enlarge the effective print area, which can be addressed in a single scan in the main scanning direction. Alternatively the respective print heads may be placed parallel to each other such that corresponding discharge elements of the respective print heads are positioned in-line in the main scanning direction. Such a parallel positioning of the print heads with corresponding in-line placement of the discharge elements is advantageous in increasing productivity and/or improving print quality.

Figure 2:
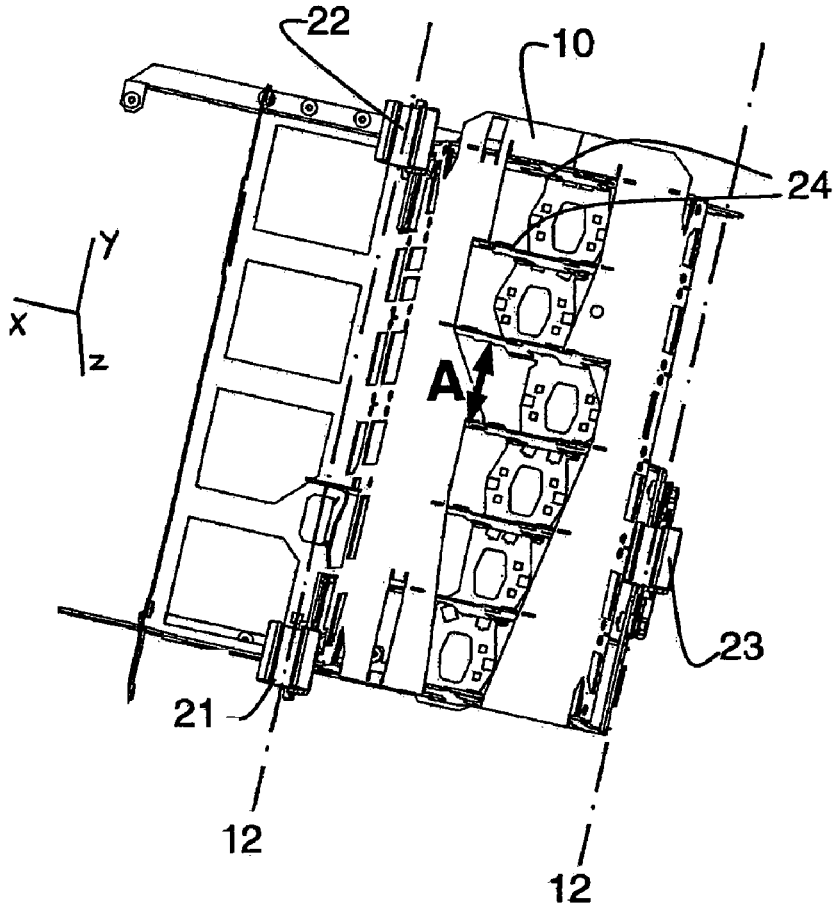
FIG. 2 depicts a more detailed view of the print carriage assembly of FIG. 1 without the print heads and print head holders.
Figure 3:
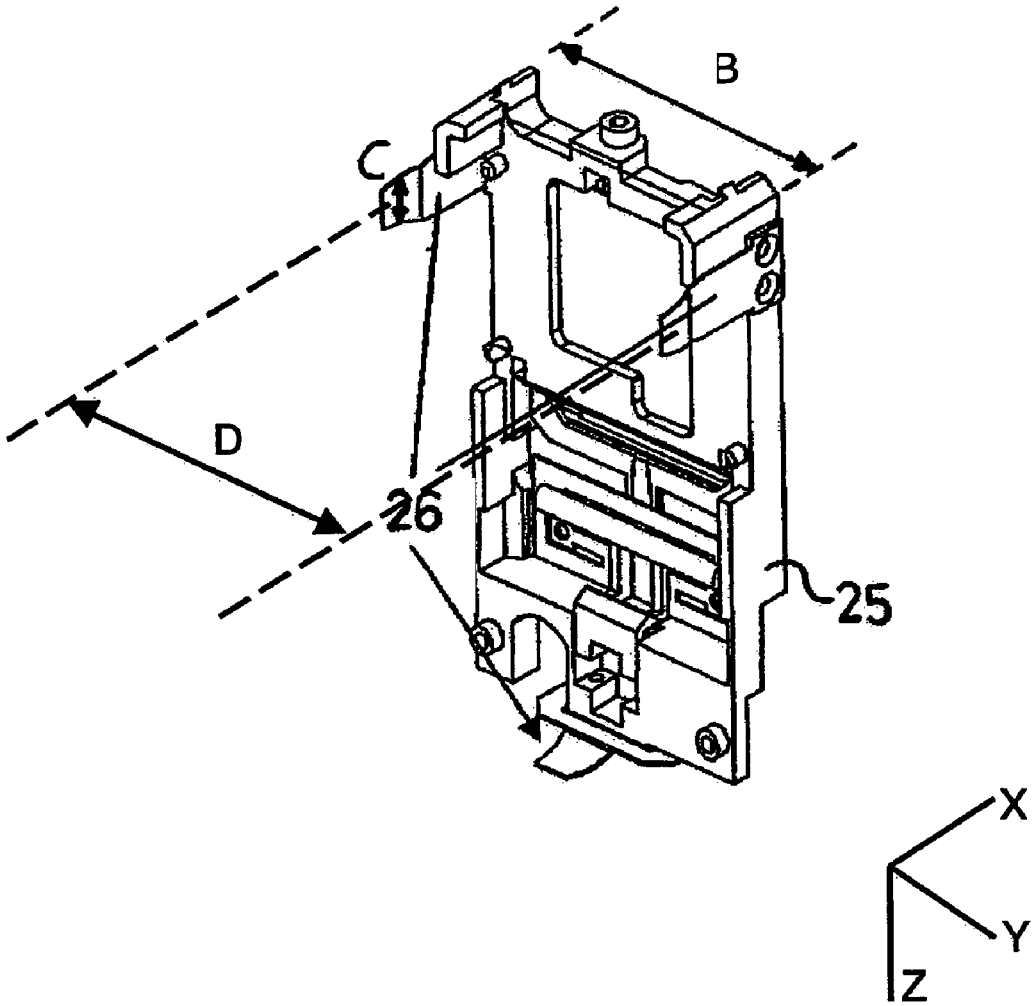
FIG. 3 depicts a print head holder according to an embodiment of the present invention.
Figure 4:
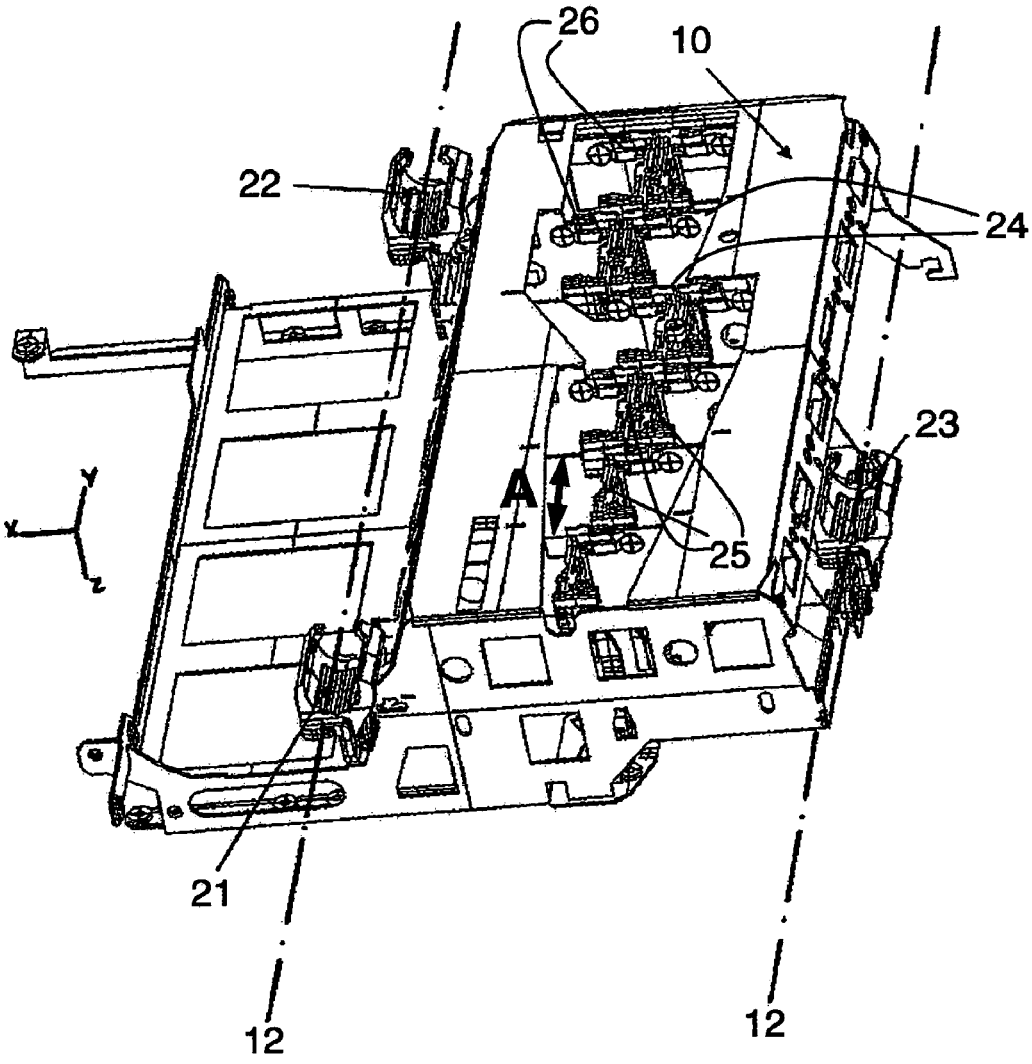
FIG. 4 depicts the print carriage assembly of FIG. 2 with print head holders as shown in FIG. 3.

In FIGS. 2 and 4, a perspective view of a print carriage assembly 10 is depicted with its bottom side up, i.e. the side facing the image receiving member when being mounted on a printing device. FIG. 2 depicts the print carriage assembly without print head holders 25 (see FIG. 3), while FIG. 4 depicts the print carriage assembly with print head holders. For the suspension and accurate positioning of the print carriage assembly on the guide member, i.e. the two parallel rods 12 of the printing device of FIG. 1, the print carriage is provided with three slide bearings 21, 22, and 23. The carriage is manufactured from a sheet metal. The thickness of the sheet metal is typically in the range of from 0.5 mm to 3 mm, such as e.g. 1 mm. The carriage is made of a metal such as steel, stainless steel or aluminium or any other metal which is readily available and can be easily manufactured. To protect the carriage against wear, corrosion or other external influences, the metal may be coated with a metal coating, such as e.g. nickel, or a coating of a metal alloy, e.g. NiCr. The coating typically has a thickness of from 1 μm to 20 μm, such as e.g. 6 μm. Five sheet metal walls 24, positioned parallel to the sub scanning direction, i.e., the X direction divide the print carriage assembly into six compartments for accommodating the print head holders 25. The distance A is the distance between two adjacent walls. As indicated in FIG. 3, the distance B is the width of the print head holder without resilient members attached thereto, while the distance D is the total width of the print head holder with the resilient members attached thereto, in a released state. The distance A and the widths B and D of the print head holder are chosen to be dependent one upon the other in order to enable the accurate inserting and positioning of the print head holder in the corresponding compartment of the print carriage assembly defined by two adjacent walls. This means that the width B is chosen to be smaller than the distance A, while D is chosen to be equal or larger than distance A. Preferably D-A is a number in the range from 0.1 to 0.4 mm. By choosing the same width for each print head holder and the same width for each print head, both the print head holders and print heads can be easily interchanged, yielding an increase in flexibility. In this example, each compartment accommodates one or two print head holders. In this example, to each print head holder a print head can be detachably attached.

Therefore, 10 print head holders are mounted on the print carriage assembly at predetermined positions to ensure proper positioning of the 10 print heads (not shown in FIG. 2) associated therewith. Leaf springs connect the respective print head holders to the respective sheet metal compartment walls 24. The print head holder will be described in more detail in conjunction with FIG. 3.

FIG. 3 depicts a print head holder 25 having three leaf springs 26 attached thereto. Two springs are attached two the upper sides of the print head holder. The third spring is attached to the center bottom of the print head holder. This configuration with three leaf springs has the advantage of being quite rigid once mounted on the print carriage assembly. In other words only very limited displacement such, as tilting, rotating or translating of the print head holder can be effectuated after mounting even when using a substantial amount of force. The print head holder may be composed of a metal such as aluminium and is accommodated such that a print head can be easily attached thereto, e.g. by clicking. The print head holder is manufactured with high precision using injection moulding. The leaf springs are composed of a metal or a metal alloy and have a thickness in the range of from 0.2 to 1 mm, preferably 0.4 mm. The width C of the leaf springs is typically in the range from 2 to 10 mm, e.g., 3 mm. The use of leaf springs as resilient members is advantageous in that a well-defined contact area can be created between each spring and the print carriage assembly. A well-defined contact area, enables the creation of a robust connection between each spring and the print carriage assembly, e.g. by welding, glueing or irradiation. It is observed however that even when there is a gap between the spring and the print carriage assembly which is smaller than 100 μm, or more preferably, smaller than 50 μm, a robust connection can still be established there-between by means of laser welding. Each of the leaf springs attached to the upper side of the print head holder are attached to the side walls or sheet metal walls 24 of the print carriage assembly. The center bottom leaf spring is attached to the bottom of the print carriage assembly. An example of a suitable metal alloy for the leaf spring is NiCr, but the present invention is in no way limited thereto.

Figure 5:
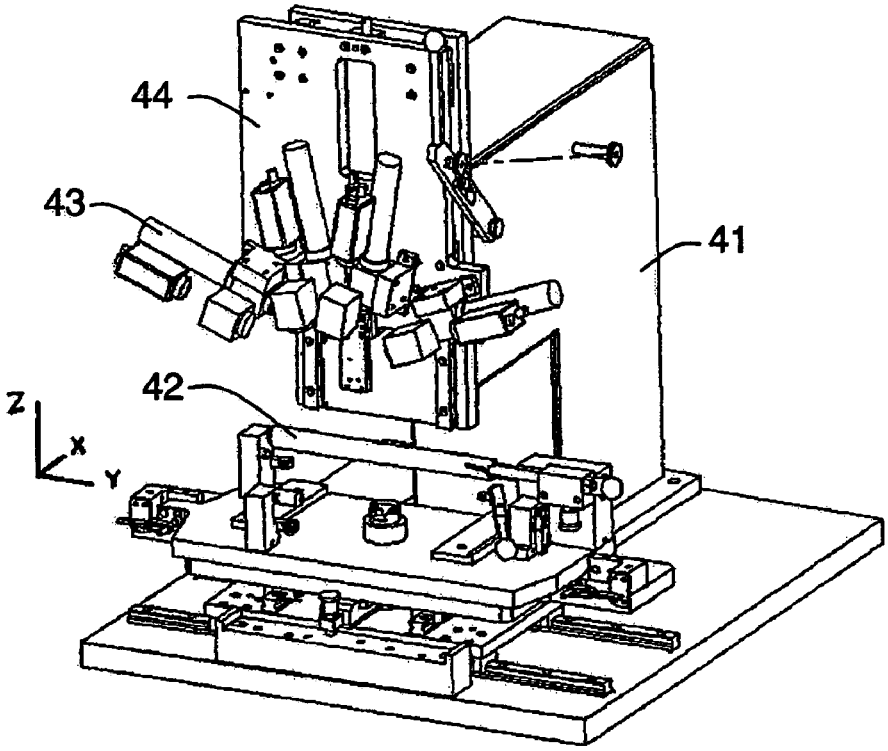
FIG. 5 is a perspective view of a mounting set-up for mounting the print head holders on a print carriage assembly according to an embodiment of the present invention.
Figure 6:
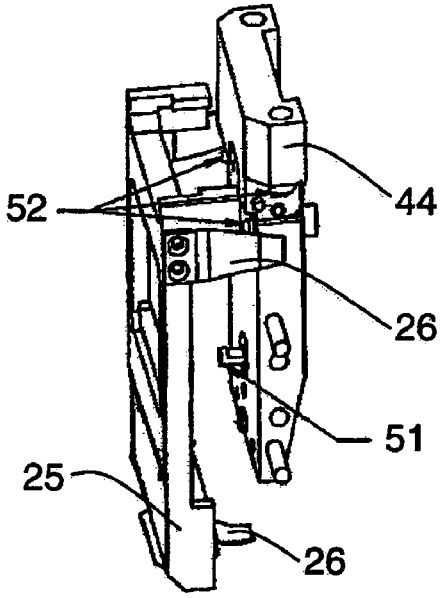
FIG. 6 shows the position and release mechanism of the print head holder with respect to the Z-sledge, which is part of the mounting set-up of FIG. 4.

With reference to the drawings, according to the present invention, a method is disclosed for mounting a plurality of print heads on a print carriage assembly of a printing device using a plurality of print head holders. The print carriage assembly to start from is a partially completed one and comprises a metal base frame defining the contours of the assembly, points of suspension for suspending the print carriage assembly on the printing device, and mounting walls dividing the print carriage assembly in compartments for accommodating the print head holders. An example of such a configuration is the print carriage assembly of FIG. 2 without the print head holders. In the print carriage assembly of FIG. 2, three points of suspension are provided in the form of slide bearings 21, 22, and 23 enabling the print carriage assembly to be moved in reciprocation across a guide member of a printing device in the main scanning direction. In this example, the guide member, in order to accommodate the print carriage, preferably comprises two parallel rods 12 extending in the main scanning direction for suspending the print carriage thereon by means of the slide bearings. A position in the sub scanning direction can be defined with respect to at least one of the rods or with respect to the point(s) of suspension associated therewith. In particular the imaginary axis connecting the slide bearing 21 with slide bearing 22 may be taken as a reference to determine the position in the sub scanning direction. In order to mount the print head holders at predetermined positions with respect to this reference line on the print carriage assembly, use is made of a mounting set-up 41 as shown in FIG. 5. A shown in FIG. 5, the mounting set-up comprises mounting means for suspending the print carriage assembly thereon in a well-defined manner. In this example the mounting means comprises a first rod 42 having dimensions matching the dimensions of the slide bearings 21 and 22 of the print carriage assembly. The mounting means may further comprise a second rod (not shown) parallel to the rod 42 for accommodating slide bearing 23. Other mounting means may be used provided the print carriage can be mounted on the mounting set-up in a stable and well-defined way enabling the accurate determination of positions within the print carriage assembly. Once mounted on the mounting set-up the print carriage assembly can be accurately displaced in the X-Y plane. In order to mount a print head holder, e.g. the print head holder of FIG. 3, on the print carriage assembly, the print head holder is temporarily clamped on a Z-sledge 44, i.e., a sledge which can be accurately displaced in the Z-direction only. This is described in more detail in conjunction with FIG. 5. The movement of the Z-sledge with the print head holder attached thereto combined with the displacement capabilities of the mounting set-up in the X-Y plane enables bringing the print head holder to its predetermined position with respect to the reference line. The positioning accuracy is within 5 μm, although in practice, the positioning accuracy within 200 μm may be satisfactory as the appropriate discharge element selection on respective print heads reduces the possible gap or overlap between the respective print heads. The alignment requirements for the print head holders in the sub-scanning direction are, however, more stringent, but nevertheless are met. The maximal misalignment may be 40 μm for a print head holder having a width of 32 mm. Once in place, lasers including focusing optics 43 are used to weld the respective leaf springs attached to the print head holder to the print carriage assembly. Subsequently, the print head holder is released from the Z-sledge thereby ending the mounting process of the print head holder. The lasers used are pulsed Nd:YAG lasers such as for instance HP54p from "Haas Laser". The laser spot is typically a spot with a diameter of 600 μm. It is further observed that the gap between the lug of a leaf spring and the print carriage assembly should be at most 100 μm. Typically one or two spot welds are used to connect each of the leaf springs with the print carriage assembly. To create a spot weld, the pulse duration is typically in the range of from 5 to 10 ms, while the pulse energy per spot was typically in the range from 5 to 10 Joule.

Referring to FIG. 5, the mechanism to clamp a print head holder to a Z-sledge and afterwards release it therefrom can be described. The print head holder 25 is shown in a released state together with a Z-sledge 44. To clamp the print head holder against the Z-sledge, the Z-sledge is provided with pressure pieces, e.g. four spring-loaded pins 52 and a spring loaded pulling hook 51. To release the print head holder from the Z-sledge, the Z-sledge is unlocked and pushed downwards such that the hook releases the print head holder.

The invention being thus described, it will be obvious that the same may be varied in many ways. Such variations are not to be regarded as a departure from the spirit and scope of the invention, and all such modifications are would be obvious to one skilled in the art are intended to be included within the scope of the following claims.

What is claimed is:

1. A printing device which comprises:

a carriage assembly containing at least one print head holder; and at least one print head for the image-wise formation of dots of a marking substance on an image-receiving member, detachably attached to said print head holder, and a guide member extending across the image-receiving member for guiding the print carriage assembly, wherein each of said print head holders is mounted on the print carriage assembly at a predetermined distance from the guide member by at least one resilient member.

2. The printing device as recited in claim 1, wherein the guide member comprises at least one rod extending across the image receiving member in the main scanning direction.

3. The printing device as recited in claim 1, wherein the print carriage assembly contains at least one slide bearing for movably suspending the print carriage assembly on the guide member.

4. The printing device as recited in claim 3, wherein the predetermined distance is determined with respect to the slide bearing.

5. The printing device as recited in claim 1, wherein each of the print head holders is mounted on the print carriage assembly by at least three resilient members.

6. The printing device as recited in claim 1, wherein each print head holder includes means for adjusting the position of the print heads attached thereto.

7. The printing device as recited in claim 1, wherein the resilient member is a leaf spring.

8. An ink jet printer as defined in claim 1.

9. A toner jet printer as defined in claim 1.

10. A method for mounting at least one print head on a print carriage assembly of a printing device using at least one print head holder, in which the print head is detachably attached to the print head holder, which comprises:

attaching at least one resilient member to each of said print head holders;

mounting each print head holder to the print carriage assembly by positioning the print head holder in said print carriage assembly at a predetermined distance from a point of suspension of the print carriage assembly; and attaching the resilient member attached to the print head holder to the print carriage assembly.

11. The method as recited in claim 10, wherein the resilient member is welded to the print carriage assembly.

12. The method as recited in claim 10, wherein the print carriage assembly further comprises at least one slide bearing for movably suspending the print carriage assembly on the printing device.

13. The method of claim 10, wherein the predetermined distance is determined with respect to the slide bearing.

14. A method for mounting at least one print head on a print carriage assembly of a printing device using at least one print head holder, in which the print head is detachably attached to the print head holder, which comprises:

attaching at least one resilient member to each of said print head holders, said resilient member being welded to the print carriage assembly, mounting each print head holder to the print carriage assembly by positioning the print head holder in said print carriage assembly at a predetermined distance from a reference point; and attaching the resilient member attached to the print head holder to the print carriage assembly.

* * * * *